United States Patent [19]

Itoh

[11] 4,423,609

[45] Jan. 3, 1984

[54] SINGLE-OPERATION TYPE OF FASTENING DEVICE FOR BOBBIN SPACER

[75] Inventor: Takeji Itoh, Kasugai, Japan

[73] Assignee: Osaka Bobbin Kabushiki Kaisha, Osaka, Japan

[21] Appl. No.: 327,542

[22] Filed: Dec. 4, 1981

[51] Int. Cl.[3] ..... D06B 23/04; B65H 49/20

[52] U.S. Cl. ..... 68/212; 242/68.3; 242/129.71

[58] Field of Search ..... 68/20, 189, 198, 212; 242/68.3, 129.7, 129.71, 130; 34/104

[56] References Cited

U.S. PATENT DOCUMENTS

| | | | |
|---|---|---|---|
| 1,476,021 | 12/1923 | Peterson | 242/129.7 |
| 1,763,861 | 6/1930 | Peterson | 242/129.7 |
| 3,481,165 | 12/1969 | Tigges | 68/212 X |
| 3,731,502 | 5/1973 | Stearns et al. | 68/212 X |
| 3,777,516 | 12/1973 | Tigges | 68/198 |

FOREIGN PATENT DOCUMENTS

| | | | |
|---|---|---|---|
| 629484 | 10/1961 | Canada | 242/129.7 |
| 2558440 | 6/1977 | Fed. Rep. of Germany | 68/212 |

*Primary Examiner*—Stephen Marcus
*Assistant Examiner*—Joseph M. Pitko
*Attorney, Agent, or Firm*—Flynn, Thiel, Boutell & Tanis

[57] ABSTRACT

A quick-release fastening device for securing a bobbin spacer to a spindle on which bobbins are axially mounted while allowing the absorption of thermal expansion of the bobbins, which device comprises a locking rod adapted to be firmly secured, at one end, to the spindle. The rod has an annular groove therein. Upper fastening means includes a sleeve slidably fitted on the locking rod which sleeve has ball-holding holes at the position corresponding to the annular groove and balls are located in the holes. A locking slide member is mounted on the sleeve which member is slidable freely along the sleeve and has a recess at its inner side. A compression spring is disposed in the recess and serves to cause sliding of the slide member. A flange member is provided surrounding the uppermost part of the sleeve above the recess and is fitted in the locking member. The balls are held between the annular groove of the locking rod and the slide member. The thermal-expansion-absorbing means includes a slidable ring mounted on the outer periphery of the sleeve which ring is adapted to be firmly secured onto the bobbin spacer, a spring-supporting member secured to the sleeve above the slidable ring, and a compression spring interposed between the slidable ring and spring-supporting member, the spring serving to absorb thermal expansion of bobbins by its resiliency. When the slide member is slid up or down, the locking rod can be released from or fastened to the entire assembly consisting of the sleeve and associated components by the disengagement or engagement of the balls.

9 Claims, 5 Drawing Figures

SINGLE-OPERATION TYPE OF FASTENING DEVICE FOR BOBBIN SPACER

This invention relates to a bobbin holding device for mounting and firmly holding a plurality of bobbins stacked one upon another on a spindle in the axial direction when yarn cops wound around the bobbins (hereinafter simply referred to as "cops") are treated for dyeing, drying or other purpose. More particularly, it relates to a single-handling type of spacer fastening device with which bobbins can be attached or detached singly and can be firmly secured to the spindle, and thermal expansion thereof caused upon dyeing can be absorbed.

Treatments for dyeing yarns wound around bobbins have been conducted widely. Such yarn-wound bobbins to be used for dyeing undergo change or displacement upon dyeing and drying, varying among the bobbins depending upon their quality of material owing to the fact that the bobbins or cops expand or contract. In particular, there is formed a void space between an upper spacer secured to the uppermost bobbin and the outermost surface of the cop layers. As a result, the flowing action of a dyestuff solution through the bobbins is aggravated, thus not only causing an uneven dyeing, but also causing a significant loss of thermal economy.

Figure 1:
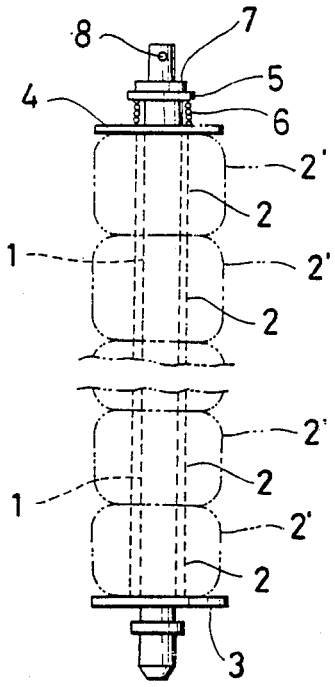
FIG.1 Prior Art

In view of the disadvantages above, there has been heretofore adopted a mechanism as shown in FIG. 1, according to which a pipe-like spindle 1 is mounted in a lower spacer 3 in the axial direction, a plurality of cops 2', 2', . . . are mounted on the spindle along its axis and are stacked and arranged in order on the lower spacer, an upper spacer 4 is mounted on the uppermost cop and secured to the spindle, and the upper spacer is made slidable by means of compression spring 6 which is contractingly mounted on the spindle so as to be extensible and extends between the upper spacer and a spring pressing member 5, whereby the compression spring serves to force a series of bobbins 2, 2, . . . toward the lower spacer. With this mechanism, even if the bobbins 2, 2, . . . expand in the axial direction, the upper spacer 4 is displaced upwardly by the magnitude of the expansion, and mutual contact pressures of the bobbins are not raised so much. In this way, the mechanism was devised so that dyestuff solution may not be prevented from flowing through the bobbins and heat transfer may not be precluded.

However, this prior art bobbin holding device has many drawbacks and problems. When the bobbins 2, 2, . . . on the spindle 1 are replaced with other new bobbins, a troublesome, complicated and time-consuming operation is required for detaching the present bobbins from the spindle and attaching the new bobbins to the spindle, since the bobbins must be detached from the spindle by turning a fastening member 7 which is threaded on the end of the spindle and is applied to the spring-touching element 5 by inserting a suitable stick into a through-hole 8 defined on the member 7 perpendicularly to its axis. Particularly when the fastening member 7 is detached, the spring-touching element 5, the compression spring 6 and the spacer 4 are also simultaneously detached, which may cause the mishap that the spring-touching element 5 is likely to be sprung out with the resilience force of the compression spring 6, and as a result, the operator may be injured by the tip of the spring released. Further, it requires troublesome labor again to assemble and fabricate the fastening member, compression spring, spring-touching element and spacer thus disassembled into the spacer holding device. A further problem is that the threaded portion linking the fastening member 7 and the spindle 1 becomes worn away as the operation for bobbin replacement is repeatedly conducted, and mutual contact pressures among the bobbins vary depending upon the driving magnitude in the threaded portion, so that great care must be taken for the operation.

The present invention is therefore designed to avoid the drawbacks of the prior art bobbin holding device as described above.

A primary object of this invention is to provide a bobbin retainer fastening device in which a fitment or fitting for fastening or pressing an upper spacer mounted on a spindle holding a plurality of bobbins can be readily and securely attached to or detached from a lock means joined to the spindle by a single-operation, in order to attach or detach the bobbins.

Another object of this invention is to provide a bobbin spacer fastening device in which the fitment is integrally constructed so as not to disassemble upon attaching or detaching bobbins, whereby the operation is conducted rapidly.

According to this invention, there is provided a single-operation type of fastening device for a bobbin spacer or retainer provided with a thermal expansion absorber for bobbins which comprises a locking rod adapted to be secured firmly to a spindle on its axis, which spindle is mounted with bobbins stacked on a lower retainer thereon, the locking rod having an annular groove therein; a sleeve slidably fitted to the locking rod which has a plurality of ball-holding holes in association with the annular groove and has locking balls in said holes; a thermal expansion absorbing means for bobbins mounted on the sleeve comprising a slidable ring to be pressed against an upper spacer, a spring supporting member provided above the slidable ring, and a compression spring interposed between the slidable ring and spring supporting member, the compression spring being extensible or contractable up and down; and a slidable locking member mounted on the sleeve above the spring supporting member, the locking member being slidable freely up or down and serving, upon sliding up, to unlock the sleeve and other elements mounted on the sleeve from the locking rod by the disengagement of the balls from the annular groove in the locking rod and, upon sliding down, to lock the former to the latter by the engagement of the balls with the annular groove.

With the device of this invention, by only one sliding action of the locking member, the sleeve, locking member, slidable ring, spring supporting member and compression spring, as a whole, can be unlocked out of or locked in the locking rod.

Figure 2:
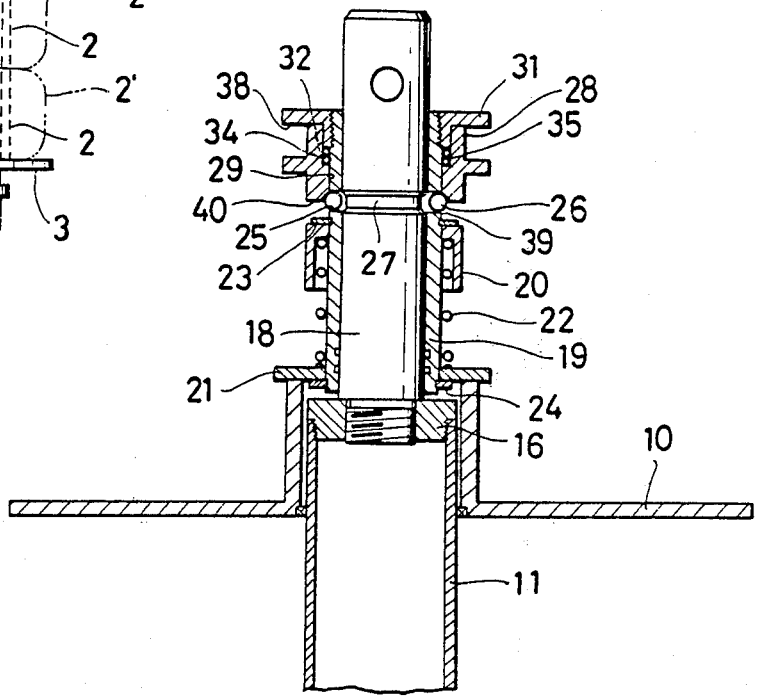
Figure 2:
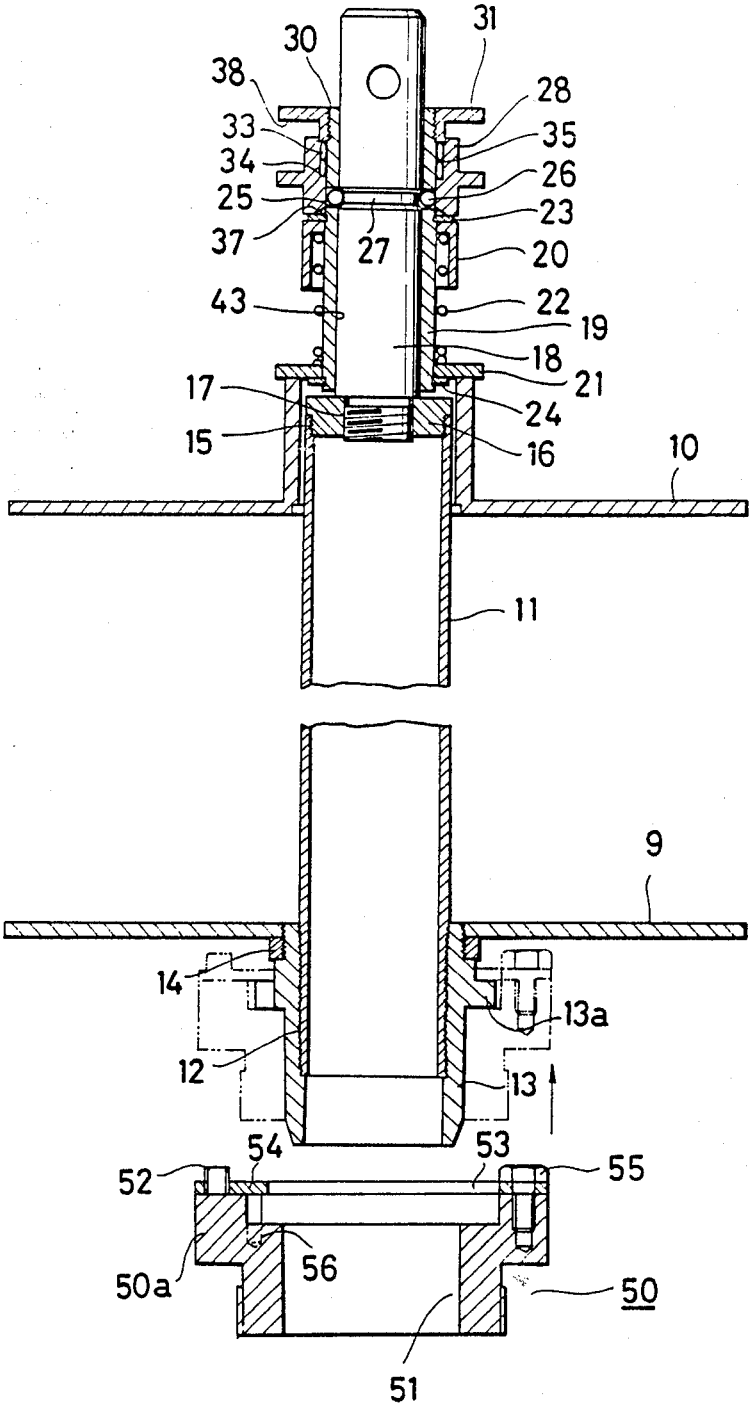
Figure 3:
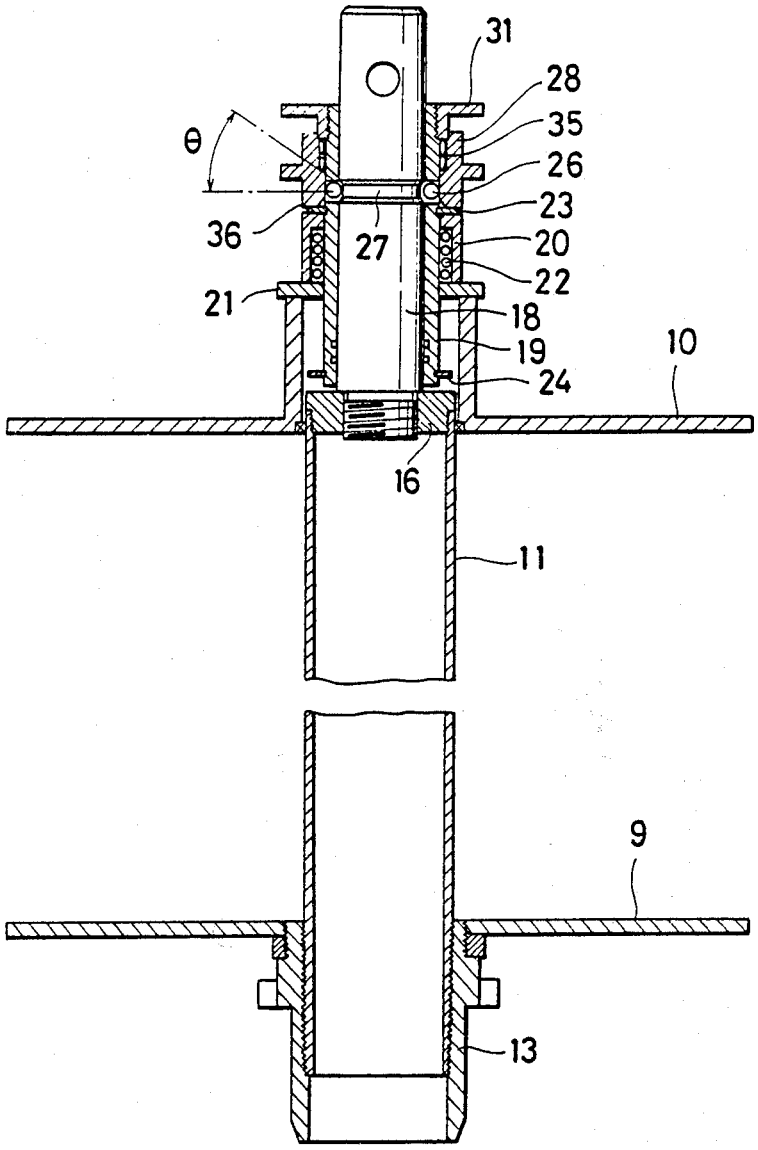
Figure 4:
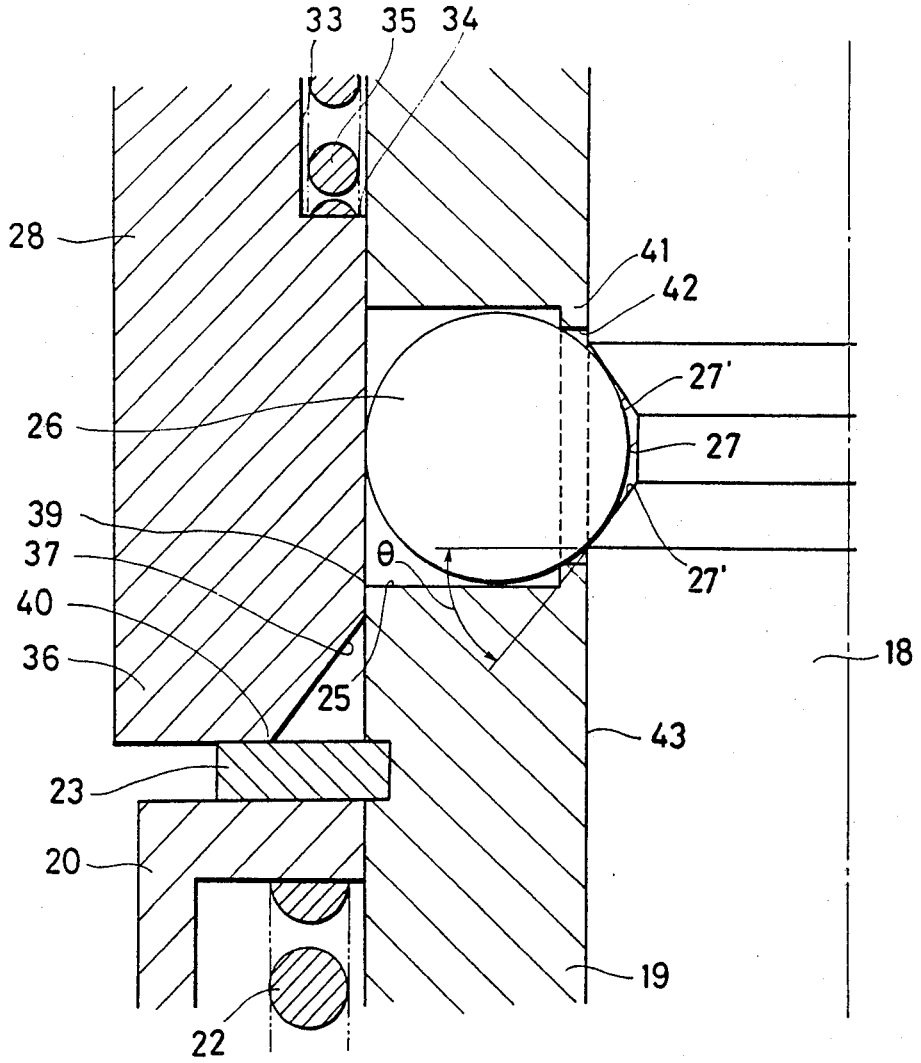

This invention will be hereinafter described in more detail by way of preferred embodiments with reference to the accompanying drawings, in which:

FIG. 1 is a schematic elevational view of a prior art bobbin holding device;

FIG. 2*a* and FIG. 2*b* are each an elevational view in cross-section of one example of bobbin spacer fastening device according to this invention, which is set for use, but not during treatment, the former showing the state where the balls are engaged, and the latter showing the state where the balls are disengaged;

FIG. 3 is a sectional elevational view of the same embodiment as FIGS. 2*a* and 2*b* showing the state of the fastening device when the bobbins are expanded during treatment; and FIG. 4 is an enlarged sectional view of the ball portion pertaining to another example of this invention.

Now, referring to FIG. 2*a*, FIG. 2*b*, and FIG. 3, a plurality of bobbins arranged in the axial direction (not shown) are held between upper and lower spacers or retainers 10, 9 in a similar manner to the bobbins shown in FIG. 1.

The lower spacer 9 is threadedly secured to a threaded portion 14 on the end of the outer periphery of a sleeve 13 which is fixedly threaded onto the threaded portion 12 of a cylindrical spindle 11 notched at the lower end thereof. On a threaded portion 15 at the upper end of the spindle 11 there is threaded a disk-shaped adapter 16 whose central screw thread 17 formed axially is threaded with a threaded portion of a locking rod 18 axially therein.

A sleeve 19 is fitted to the locking rod 18 on the outer periphery thereof so as to be slidable freely along it. A spring supporting member 20 is slidably mounted on the sleeve 19. A slidable ring 21 is mounted, on the sleeve 19 and is tightly pressed against the central upper end of the upper spacer 10. The spring supporting member 20 and the slidable ring 21 are urged by a helical compression spring 22 provided between them toward an upper stop ring 23 and a lower stop ring 24, both attached to the sleeve 19, respectively.

The sleeve 19 has radial apertures providing a plurality of ball-holding holes 25 thereon at a position above the upper stop member of ring 23, which holes hold balls 26 therein. The balls 26 are held and clasped between an annular groove 27 defined on the locking rod 18 and the inner face 29 of a slide locking member 28, whereby they are restrained from shifting in the radial direction of the locking rod 18. The slide member 28 is mounted on the sleeve 19 in a place above the upper stop ring 23 so as to be slidable on the sleeve. It is always urged toward the stop ring 23 by means of a second compression spring 35 which is provided between the end 32 of a flange member 31 threaded on the top portion 30 of the sleeve 19 and the lower end 34 of a recessed portion 33 of the slide member 28 (see FIG. 4).

The lower end 36 of the slide member 28 is formed with a beveled or downwardly and outwardly flaring portion 37 so that when the slide member 28 is moved in the arrow direction as shown in FIG. 2*a* until it comes in contact with the lateral portion 38 of the flange member 31, the balls 26 are disengaged from the inner face 29 of the slide member and released from the annular groove 27 with the result that they are permitted to float radially outwardly of the locking rod 18. In this situation (FIG. 2*b*), the radius of the balls 26 is larger than the distance between the bottom edge 39 of the ball-holding holes 25 and the lower end 40 of the beveled portion 37, so that they never drop out of the holes 25.

The fixed sleeve 13 threaded on the threaded portion 12 at the lower end of the spindle 11 can be secured to the spindle 11 sufficiently by merely threading the lower spacer 9 onto the threaded portion 14 on the outer periphery thereof, as shown in FIG. 3.

However, in order to more efficiently and securely hold the spindle 11 there may be provided a spindle clasping member 50 as illustrated in FIG. 2*a*. The spindle clasping member 50 is apertured at a hole 51 in the central portion thereof and is formed to be a short cylindrical member having a flange portion 50*a* of a larger radius at the upper end thereof. An annular plate 53 is attached to the upper end of the spindle clasping member 50 by means of a screw 55 so as to be microadjustable up or down with the aid of a contact-pressure regulating bolt 52. In the inner periphery of the annular plate 53, there are provided engaging members 54 protruding radially inwardly at intervals of 120°. The engaging members 54 serve to move rotatingly somewhat, when the spindle clasping member 50 is fitted to the lower end of the fixed sleeve 13 through the central hole 51, thereby to shift above the projecting portion 13*a* which is provided on the outer periphery of the fixed sleeve 13 in alignment with the engagement members 54. In this way, the spindle 11 can be firmly held and clasped at the lower spacer 9 by a single operation.

The reference numeral 56 in FIG. 2*a* designates a stopper pin capable of retarding excess rotative movement of the spindle clasping member 50.

In FIG. 4, a preferred example of the construction of the ball-holding hole is illustrated.

The ball-holding hole 25 is formed with a pair of upwardly and downwardly extending annular projections 41 on the side of the sleeve in contact with the locking rod 18, thus forming a small hole portion 42 between the upper and lower projections 41. The small hole portion 42 is formed to have a somewhat smaller inner radius than the outer radius of the ball 26, so that the ball 26 is urged by the inner face 29 of the slide member 28 to project inwardly of the inner peripheral face 43 of the sleeve 19 and to become tangential to the slanted walls 27', 27' of the annular groove 27. As a consequence, the ball 26 is, when the sleeve 19 is released from the locking rod 18, still engaged with the projections 41 and therefore does not drop down inwardly of the sleeve 19.

The operation and function of this invention will now be described with reference to the embodiments thus far described.

When the upper spacer 10 is to be detached from the spindle 11 and a new set of bobbins is to be mounted on it, in the first place, the slide member 28 is moved in the arrow direction (upwardly) as shown in FIG. 2*a* and consequently the balls 26 and the inner face 29 of the slide member 28 are brought out of contact with each other. Thus, the balls which have been graspingly held between the annular groove 27 and the inner face 29, and accordingly have been restrained from shifting in the radial direction of the locking rod 18 are enabled to move out of contact with the inner face 29 and to float. As a result, the sleeve 19 becomes movable freely along the locking rod 18 in the arrow direction. Concurrently with the movement of the sleeve 19, the sleeve 19, the flange member 31 mounted on it, the slide member 28, the balls 26, the compression springs 22, 35, the slidable ring 21, and the stop rings 23, 24 are, in the aggregate, displaced in the arrow direction and are detached from integral engagement with the locking rod 18. In this way, the spacer 10 can readily be detached and the replacement with new bobbins is now ready for mounting.

The new bobbins are mounted on the spindle 11 in a usual way and subsequently, the spacer 10 is mounted in axial direction of the spindle.

Then, the fastening device as detached is again set in attachment.

In attaching the fastening device to the spacer, those members integrally disjoined from the locking rod 18 are again unitedly fitted to the outer periphery of the rod 18, and the sleeve 19 is pushed down in the opposite direction to the arrow direction in FIG. 2*a* while the balls 26 are given freedom of movement. At that time, the slide member 28 is slid down to the position where it touches to the stop ring 23 by means of the compressive spring 35 as shown in FIG. 3, the inner face 29 thereof forcing the balls 26 into the annular groove 27. The sleeve 19 then no longer slides on the locking rod 18. Simultaneously, the slidable ring 21 is returned to the state of FIG. 2*a* by means of the spring 22. Upon such a firmly fastened bobbin assembly, cops are provided by yarn winding.

In the fastening device for a bobbin spacer according to this invention, the annular groove 27 aids significantly in stopping the sliding movement of the sleeve 19 by the engagement of the balls 26 therewith and inversely in disengaging the balls 26 therefrom by the movement of the slide member 28. In order to optimize these functions, it is preferred to make the slant angle ($\theta$) of the diverging, opposing slanted walls 27' of the annular groove 27 (see FIG. 4) 30° to 40°, but it is most preferred to make it about 35° relative to the normal of the rod surface.

Following the bobbin replacement and cop provision operations a dyestuff solution is flowed through the bobbin assembly in the state wherein the cops are firmly held between the upper and lower spacers 10, 9 as shown in FIG. 2*a* by the usual procedure.

As usual, the dyeing process and the subsequent drying process are conducted in sequence.

When the dyestuff solution is flowed through, the bobbins and the yarn layers are distended with the flowing of the solution, thereby exerting an expansion pressure upon the upper spacer. Then, the slidable ring 21 contiguous to the upper spacer 10 receives the pressure against the spacer, separates from the stop ring 24 and rises upwardly while contracting the spring 22. It absorbs the foregoing expansion pressure and ultimately reaches the position shown in FIG. 3.

Upon dyeing and drying, the dyestuff solution, drying liquid and steam air are free from leaking since the upper end of the spacer 10 is always tightly in contact with the slidable ring 21.

In this way, dyeing, heat treatment or any other treatment can be conducted while holding the cops between the spacers in a suitable state, and it is possible to replace the cops in a simple operation.

For the spacer fastening device thus constructed above, a single operation is used to detach and attach it upon replacement bobbins. That is, by only the drawing action on the slide member near to the flange member, the sleeve is unlocked from the locking rod and the sleeve-side counterpart is therefore unitedly, readily pulled out of it, whereas setting of the fastening device requires only the action of inserting and pushing the sleeve assembly into the locking rod.

The elements constituting the sleeve assembly, i.e., the sleeve, compression spring, slide member and others are assembled and fabricated integrally, not in a separate form, so that they are free from separating upon engaging or disengaging of the sleeve with or from the locking rod. As a consequence, the efficiency of the bobbin substitution operation is remarkably enhanced, and the hazard of injury owing to bounding of the compression spring is completely avoided.

Every time bobbins are replaced, there is no need of unfastening the screw thread of the locking rod, and accordingly, destruction of the thread portion thereof is avoided.

By making the notch-defining angle ($\theta$) of the annular groove about 35°, the sleeve is ensured to be set to the locking rod with a sufficient force, and can be readily released from it.

Further, the fastening device and the spacer are tightly joined together with a constant force by means of the compressive spring, so that the fastening device can absorb the expansion of bobbins upon dyeing, drying, etc. Hence, the bobbins are free from deforming, the dyeing effect is not lowered, and the leakage of dyestuff solution or hot air is avoided.

I claim:

1. A quick-release fastening device adapted for securing a bobbin retainer to a spindle having a plurality of bobbins mounted thereon so that the bobbin retainer contacts the uppermost bobbin, and for allowing axial movement of said bobbin retainer in response to axial expansion of said bobbins, which device comprises:

a spindle having a bobbin retainer mounted thereon adjacent the upper end thereof;

a locking rod fixedly secured at the lower end thereof to the upper end of said spindle so as to extend axially from said spindle, said locking rod having an annular groove in the periphery thereof;

a sleeve axially slidably fitted on said locking rod, said sleeve having a plurality of radial holes therein which holes are alignable with said annular groove;

a plurality of locking balls disposed in said holes so that the radially innermost portions of said balls are releasably receivable in said annular groove whereby to prevent axial movement of said sleeve with respect to said locking rod;

a slidable ring mounted on the outer periphery of said sleeve at the lower end thereof, said ring bearing against said bobbin retainer;

a stop member secured to said sleeve at a position above said slidable ring;

a helical compression spring encircling said sleeve and interposed between said slidable ring and said stop member, said compression spring urging said slidable ring axially away from said stop member and into bearing contact with said bobbin retainer, said compression spring being adapted to permit axial movement of said bobbin retainer in response to axial expansion of the bobbins;

an axially slidable locking member mounted on the outer periphery of said sleeve and positioned above said stop member, said locking member being freely axially slidable along said sleeve and having an internal recess in the upper end thereof, said locking member having an inner surface for retaining said balls in said annular groove in said locking rod when said locking member is in its lower position and having a portion adapted to release said balls from said annular groove when said locking member is in its upper position;

a flange member fixedly mounted on the periphery of said sleeve above said locking member, said flange member having a portion fitted in said recess; and a second compression spring provided in said recess of said locking member in abutment with said portion of said flange member, said second compression spring urging said locking member axially downwardly away from said flange member into its lower position, said balls being held in said annular groove by the inner surface of said locking member when said locking member is in its lower position, said balls being releasable from said annular groove in response to upward axial movement of said locking member which causes said balls to move radially outwardly in said holes out of engagement with said annular groove, thereby releasing said sleeve from said locking rod.

2. A fastening device according to claim 1, wherein said annular groove is defined by a pair of diverging, opposing walls each defining an angle in the range of 30°–40° relative to a line normal to the surface of said locking rod.

3. A fastening device as claimed in claim 2, wherein said angle is about 35°.

4. A fastening device as claimed in claim 1, wherein said slidable locking member is movable between a lowermost position wherein said locking member engages the upper surface of said stop member and an uppermost position wherein said locking member engages the lower surface of said flange of said flanged member.

5. A fastening device as claimed in claim 4, wherein said locking member has a downwardly, radially outwardly inclined surface on the inner periphery thereof at the lower end thereof, which inclined surface engages said balls during downward movement of said locking portion, whereby said balls slide along said inclined surface and are moved into said groove.

6. A fastening device according to claim 1, further comprising a lower second stop member secured to said sleeve at a position below said slidable ring, which second stop member acts to prevent movement of said slidable ring due to the urging of said first spring past said lower stop member.

7. A fastening device as claimed in claim 1, further comprising an annular spring-supporting member axially slidably mounted on said sleeve below said stop member, said spring-supporting member having a second internal recess in the lower end thereof, an upper end portion of said compression spring being disposed in said second recess and being in abutment with the inner end of said second recess, whereby said spring-supporting member is held in abutment with said stop member at an upper end of said spring-supporting member, the lower end of said spring-supporting member defining an uppermost position of said slidable ring when said slidable ring is in contact with said lower end of said spring-supporting member.

8. A fastening device according to claim 1, wherein said locking rod is of substantially cylindrical shape.

9. A bobbin holder, comprising:

a spindle on which a plurality of bobbins can be coaxially mounted;

a pair of upper and lower bobbin retainers mounted on said spindle, each of said bobbin retainers having an opening therein and said spindle extends through said openings, said lower retainer being secured in a fixed position at the lower end of said spindle and said upper retainer being slidably disposed at the upper end of said spindle;

a locking rod coaxial with said spindle and secured at its lower end to the upper end of said spindle, said locking rod having an annular groove in the periphery thereof, said groove being coaxial with said locking rod;

a sleeve axially slidably mounted on the outer periphery of said locking rod, said sleeve having a plurality of radially extending holes herein, said holes being alignable with said annular groove;

a plurality of locking balls disposed in said holes, the radially innermost portions of said balls being receivable in said annular groove to prevent axial movement of said sleeve relative to said locking rod;

an axially slidable ring disposed on the outer periphery of said sleeve on the lower end portion thereof;

a first stop member secured to said sleeve at a position above said slidable ring;

a first compression spring helically wound around the outer periphery of said sleeve, said first spring being interposed between said first stop member and said slidable ring, whereby said spring urges said slidable ring downwardly into sealing contact with an upper end portion of said upper bobbin retainer, which upper end portion defines said opening in said upper bobbin retainer, whereby said upper bobbin retainer can move upwardly due to expansion of said bobbins against the action of said first spring;

an axially slidable locking member mounted on the outer periphery of said sleeve above said stop member, said locking member having a recess formed in the upper end thereof;

a second stop member secured to an upper end portion of said sleeve above said locking member; and a second compression spring disposed in said recess in said locking member, the upper end of said second spring being in abutment with the lower end of said second stop member, the lower end of said second spring being in abutment with said locking member, whereby said locking member is urged to a downwardmost position into abutment with the upper side of said first stop member, said balls being held in said radially innermost positions thereof by contact with the inner periphery of said locking member when said locking member is in its downwardmost position, and said balls being disengageable from said annular groove by upward movement of said locking member whereby said balls move radially outwardly in said holes out of engagement with said annular groove to respective radially outermost positions, thereby releasing the assembly of said sleeve, locking member, slidable ring, said first and second stop member, said first and second compression springs, and said balls from engagement with said locking rod.

* * * * *